US007081071B2

(12) United States Patent
Smith

(10) Patent No.: US 7,081,071 B2
(45) Date of Patent: Jul. 25, 2006

(54) WEIGHTLIFTING BELT HOOK

(76) Inventor: Robert C. Smith, 5024 Pebble Valley Dr., Cincinnati, OH (US) 45252

( * ) Notice: Subject to any disclaimer, the term of this patent is extended or adjusted under 35 U.S.C. 154(b) by 464 days.

(21) Appl. No.: 10/202,744

(22) Filed: Jul. 25, 2002

(65) Prior Publication Data

US 2004/0018921 A1 Jan. 29, 2004

(51) Int. Cl.
*A63B 21/065* (2006.01)

(52) U.S. Cl. ..... 482/105; 482/93; 482/96; 482/148

(58) Field of Classification Search ..... 482/98, 482/104–109, 139; D21/683; D8/370, 373; 211/85.5, 119, 106.01, 85.31, 125; 248/218.1–218.2, 248/304, 215, 302, 339–341, 303; 224/269, 224/904, 270, 185, 666–668, 268, 271, 254–256, 224/163; 2/300, 302, 314, 315, 319, 320; 223/DIG. 4; D6/317; D3/215, 221, 254
See application file for complete search history.

(56) References Cited

U.S. PATENT DOCUMENTS

| | | | | | |
|---|---|---|---|---|---|
| 409,239 | A | * | 8/1889 | Roller | 248/304 |
| 882,181 | A | | 3/1908 | Thomas | |
| 892,991 | A | | 7/1908 | Hepworth | |
| 2,194,609 | A | * | 3/1940 | Miller | 248/339 |
| 2,441,115 | A | | 5/1948 | Lambert | |
| 3,285,482 | A | * | 11/1966 | Bedsaul, Sr. | 224/268 |
| 3,322,425 | A | | 5/1967 | Moore | |
| D216,680 | S | * | 3/1970 | Hulsey | D8/370 |
| 3,751,031 | A | | 8/1973 | Yamauchi | |
| D241,222 | S | * | 8/1976 | Edwards | D8/371 |
| D275,527 | S | * | 9/1984 | Gee | D3/215 |
| 4,589,658 | A | | 5/1986 | Gibson | |
| 4,676,502 | A | | 6/1987 | Mahr | |
| 4,944,509 | A | | 7/1990 | Snider | |
| 4,948,122 | A | | 8/1990 | Andrews, Sr. | |
| 4,984,786 | A | | 1/1991 | Lemke et al. | |
| 5,167,600 | A | | 12/1992 | Baird | |
| 5,588,940 | A | | 12/1996 | Price et al. | |
| 5,971,339 | A | * | 10/1999 | Falasco, Jr. | 248/339 |
| 5,997,494 | A | * | 12/1999 | Watkins et al. | 602/36 |
| 6,171,220 | B1 | | 1/2001 | Lumpkin | |
| D470,393 | S | * | 2/2003 | Kelleghan | D8/356 |
| D477,526 | S | * | 7/2003 | Goodman et al. | D8/370 |
| 6,715,728 | B1 | * | 4/2004 | Nielsen | 248/339 |

* cited by examiner

*Primary Examiner*—Gregory L. Huson
*Assistant Examiner*—Victor K. Hwang
(74) *Attorney, Agent, or Firm*—Wood, Herron & Evans, LLP

(57) ABSTRACT

A weightlifting belt hook to support additional weight during weight training. The apparatus is attached to the user's weightlifting belt via a hook and holds disk weights generally at the level of the thighs. A downwardly extending stabilizing member configured to extend over the pelvic area and provide an opening extends from the hook, and a weight supporting member extends upwardly and away from the bottom of the downwardly extending stabilizing member. Exercise disk weights are placed over the weight supporting member and rest near the bottom of the weight supporting member.

12 Claims, 2 Drawing Sheets

WEIGHTLIFTING BELT HOOK

FIELD OF THE INVENTION

The present invention is directed to a weightlifting belt hook for use in performing exercises that utilize a weight trainer's body weight as a source of resistance. The present invention is securable about the user's weightlifting belt at the user's waist and allows the user to increase his effective body weight by the attachment of additional weight to the weightlifting belt hook. Once the user has attached the weightlifting belt hook and the additional weight, various exercises can be performed. Since the user's effective body weight can be increased by attachment of additional weight to the belt hook, the desired natural progression of increased resistance in proportion to increased strength can be achieved.

BACKGROUND OF THE INVENTION

Exercises that utilize the user's own body weight as the source of resistance are some of the most effective weight training exercises. However, it is often the case that a person wishes to add weight to provide more resistance in order to provide overall conditioning to the body. Exemplary exercises include squats, pull-ups, chin-ups, and dips. These and other similar exercises are often performed without machines or weights. The body weight of the user serves as the only source of resistance. Squats are often performed through the positioning of a barbell or other weight holder. For instance, in the past, squat exercises have been performed by a person balancing a weight on his or her shoulders behind the neck, and thereafter squatting while supporting the weight in this manner. This presents numerous drawbacks, most notably if the person has injured his or her back, or does not have sufficient back strength to support enough weight necessary to properly exercise the muscles stressed by squat exercises.

Other exercises are performed without additional weight or with complex exercise machinery. For instance, pull-ups and chin-ups require a straight bar suspended overhead, and dips require waist-high parallel bars. This is often not possible within the confines of a home. Therefore, access to appropriate machines may not be possible.

After the user has performed these exercises for an extended period of time, his body weight becomes inadequate to fully train the target muscles. In essence, the muscles respond to the shock of training by growing. For further growth, the user must either increase the number of repetitions or sets performed, or must increase the weight. For most exercises, the choice would be to increase weight and thus resistance, but since the lifter's body weight is the only source of resistance, increasing resistance seems impossible.

Additionally, increasing the number of repetitions or sets performed is not a good alternative for most people, for these increases take more time and energy and are not particularly efficient. Many weight lifters train to increase their muscle mass. Only by increasing resistance can a noticeable increase in mass result.

Many trainers realize the benefits as well as the limitations associated with body weight resistance exercises. Accordingly, several prior art attempts have provided ways to allow trainers to overcome the limits of their own body weight.

Some devices have been designed to accomplish the task of increasing resistance by suspending extra weight from the upper body. This approach is dangerous because it raises the center of gravity, creating problems with balance. Other devices suspend weight from the waist, but involve cumbersome and uncomfortable equipment.

The prior art can be categorized in one of two groups. The first group of patents is comprised of U.S. Pat. Nos. 5,167,600 to Baird, 4,948,122 to Andrews, 4,944,509 to Snider, U.S. Pat. No. 4,676,502 to Mahr, and U.S. Pat. No. 3,322,425 to Moore. All of the foregoing patents disclose some type of backpack-like arrangement, or variation thereof, for purposes of adding body weight to the user.

U.S. Pat. No. 5,176,600 discloses a backpack-type arrangement wherein a weight is slid over a shaft and secured by a stop collar through the tightening of a screw. The shaft is connected to a cross-bar, which in turn connects to a harness. Thus, this patent discloses the addition of weight to increase the resistance in exercises in which the user's body weight is used as resistance. However, neither this patent, nor any of the other patents in this group, allows the user to move rapidly from one exercise to the next. Rather, a user must take the additional time necessary to put on a backpack-like apparatus.

The second group of patents consists of U.S. Pat. Nos. 5,588,940 to Price et al., U.S. Pat. No. 4,984,786 to Lemke et al., U.S. Pat. No. 4,589,658 to Gibson, U.S. Pat. No. 3,751,031 to Yamauchi, and U.S. Pat. No. 882,181 to Thomas. All of the foregoing patents pertain to some type of shoulder harness or belt worn by the user from which a weight is suspended using a strap or chain as a means of increasing the user's body weight.

U.S. Pat. No. 3,751,031 discloses a gymnastic apparatus in which weights having a cushioning means are suspended from a chain connected to a waist belt. Yamauchi employs cushioned weights to lessen the impact of the suspended weights when they hit a user's legs. However, although the impact to the user's legs is lessened, the swinging of the weights is not prevented, but is, in fact, enabled by the invention.

In addition, U.S. Pat. No. 5,588,940 discloses a weight supporting body harness for purposes of attaching a weight using a chain. However, this invention does not overcome the problem of the additional time required to put on the apparatus. Further, the patents in this second group fail to adequately solve the problem of the suspended weight swinging and hitting the user's legs.

Thus, a need exists for a weight supporting apparatus which will overcome the limitations of the prior art devices. The weightlifting belt hook of the present invention provides such an apparatus and is a significant improvement over the prior art devices by allowing the user to support the extra weight from the waist and thereby lower the center of gravity. The benefits of the weightlifting belt hook are twofold. First, the weightlifting belt hook facilitates rapid movement from one exercise to the next by allowing the user to simply slide the weightlifting belt hook over a lower back support belt which a weightlifter typically wears. Second, the additional weight is supported against the user's thighs in a manner which prevents it from swinging and hitting the user's legs during the exercise movements.

SUMMARY OF THE INVENTION

The present invention provides a weightlifting belt hook for use in performing exercises that utilize a weight trainer's body weight as a source of resistance. This is accomplished by providing an apparatus having a hook that can readily attach to a standard weightlifting belt. Extending from the hook is a downwardly extending stabilizing member configured to extend over the pelvic area and provide an opening. In one embodiment, the downwardly extending stabilizing member is a diamond-shaped frame. The downwardly extending stabilizing member may also be in the shape of a circle or an oval in some embodiments. In another embodiment, the downwardly extending member is a rod formed approximately in the shape of a "j" or a "J". A weight supporting member extends upwardly from the bottom of the downwardly extending member to receive additional disk weights. The weights then rest near the bottom of the weight supporting member.

The present invention can be used for various exercises, including squats, pull-ups, chin-ups, and dips. The weightlifting belt hook facilitates rapid movement from one exercise to the next by simply sliding the weightlifting belt hook over a lower back support belt. The user is then able to add weight to provide additional resistance for overall conditioning of the body. When using the weightlifting belt hook, the disk weight is positioned at the level of the thighs of the user in a manner which prevents it from swinging and hitting the user's legs during the exercise movements. The weightlifting belt hook can be made from steel or any material suitable to support the stress of additional weight.

Accordingly, an object of the present invention is to provide an exercise apparatus that is readily attachable to a lower back support belt and thus is easy to use.

Another object of the present invention is to increase the body strength of the user by adding weight to the user's natural weight.

A further object of the present invention is to provide an exercise apparatus at low cost.

A further object of the present invention is to provide an exercise apparatus that allows the user to easily change the desired amount of weight.

A further object of the present invention is to provide an exercise apparatus that lowers the user's center of gravity.

A further object of the present invention is to reduce danger and enhance the safety of the user by eliminating the swinging of the weights.

These and other objects and advantages of the present invention shall be made apparent from the accompanying drawings and descriptions thereof.

BRIEF DESCRIPTION OF THE DRAWINGS

The accompanying drawings, which are incorporated in and constitute part of this specification, illustrate embodiments of the invention and, together with the general description of the invention given above and the detailed description of the embodiments given below, serve to explain the present invention.

DETAILED DESCRIPTION

Figure 1:
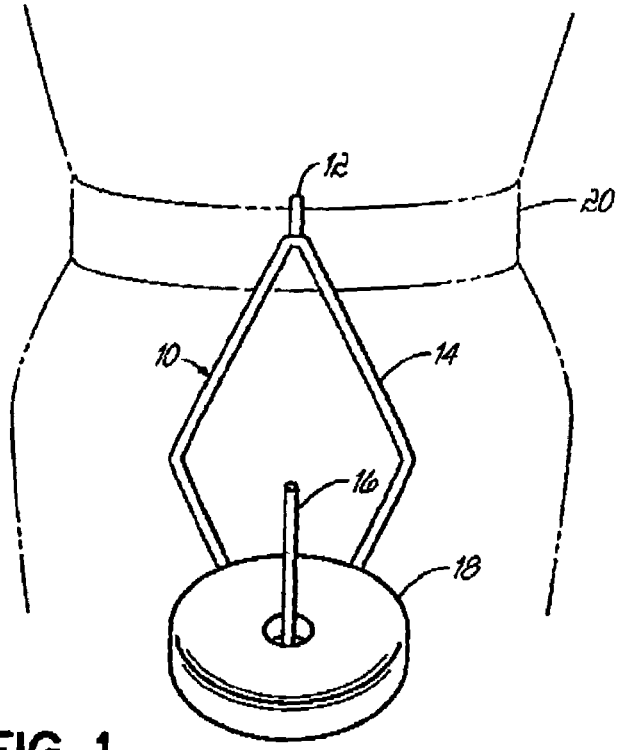
FIG. 1 is a front view of one embodiment of the weightlifting belt hook being worn by a user.
Figure 2:
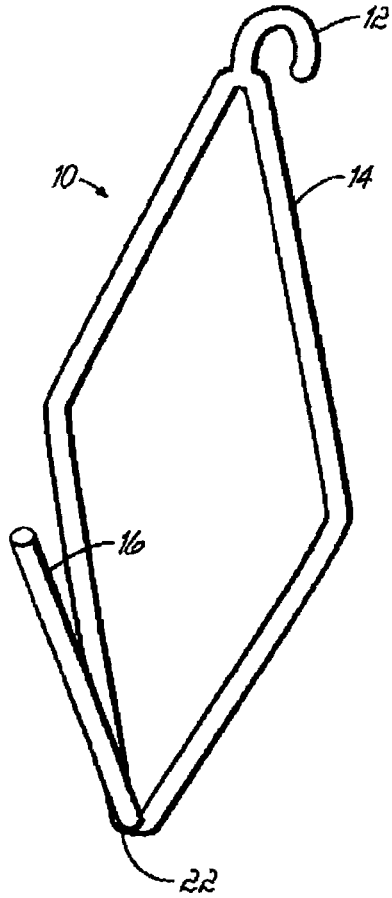
FIG. 2 is a perspective view of the weightlifting belt hook of FIG. 1.
Figure 3:
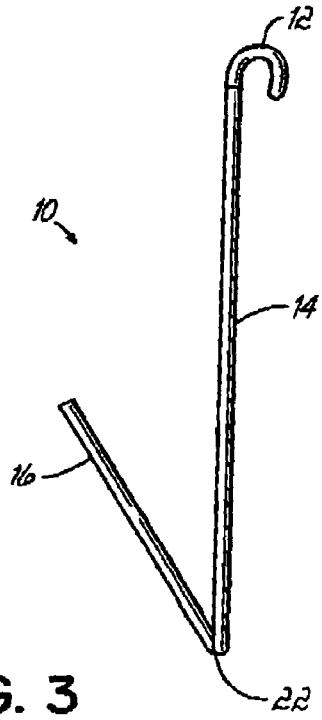
FIG. 3 is a side view of the weightlifting belt hook of FIG. 1.

Referring to FIG. 1, an exerciser is shown wearing one embodiment of the weightlifting belt hook 10, which generally includes an anchor or hook 12, a downwardly extending stabilizing member 14 in the shape of a diamond configured to extend over the pelvic area and provide an opening, and a weight supporting member 16. In use, the weightlifting belt hook 10 is secured to a weightlifting belt 20 by the anchor 12, and a weight 18 is slidably received on the weight supporting member 16. The weight rests near the bottom 22 of the weight supporting member 16.

The belt 20 may be any standard weightlifter's lower back support belt which is adapted to withstand a high degree of stress. The weight 18 may be any standard, Olympic or other type of weight having a hole in the center.

The weightlifting belt hook 10 is secured to the belt 20 by sliding the anchor 12 toward the user's body over the buckle area of a standard weightlifter's belt 20. A weight 18 or a plurality of weights (not shown) is then slidably received on the weight supporting member 16 by inserting the weight supporting member 16 into the hole in the center of the weight 18 so that the weight rests near the bottom of the weight supporting member 16 approximately at the level of the user's thighs. If desired, a second (or third, etc.) weight will rest on the previous weight 18. As the number of weights increases, less of the weight supporting member 16 will be visible. The number of weights 18 used is increased or decreased according to the user's body strength.

The weightlifting belt hook 10, as shown in FIGS. 2, 3, 4, and 5 comprises an anchor 12 which can include a hook, as illustrated. The anchor 12 can also include any other suitable structure that will secure the weightlifting belt hook 10 to a belt 20. For instance, the anchor 12 can include a closed loop that is secured to the belt 20 by a hook or clamp attached to the belt 20 (not shown). A downwardly extending stabilizing member 14 configured to extend from the anchor over the pelvic area, contains provides an opening, and generally terminates at the user's thighs. As shown, it is in the shape of a diamond. The downwardly extending stabilizing member 14 is also shown in the shape of a circle in FIG. 4 and in the shape of an oval in FIG. 5. From the bottom 22 of the downwardly extending stabilizing member 14, a weight supporting member 16 extends upwardly and away from the user. It is apparent to one skilled in the art that the angle of the weight supporting member 16, in relation to the downwardly extending stabilizing member 14, should be less than 90°, such that the weights do not fall off the weight supporting member 16. The weight supporting member 16 is of sufficient length to support a plurality of weights. The weightlifting belt hook 10 can be made from steel or any other suitable material.

The advantages of the present invention are twofold. First, the weightlifting belt hook facilitates rapid movement from one exercise to the next by allowing the user to simply slide the weightlifting belt hook over a lower back support belt which a weightlifter typically wears. Thus, the weightlifting belt hook is readily attachable. Second, the additional weight is supported against the user's thighs in a manner which prevents it from swinging and hitting the user's legs during the exercise movements.

Figure 6:
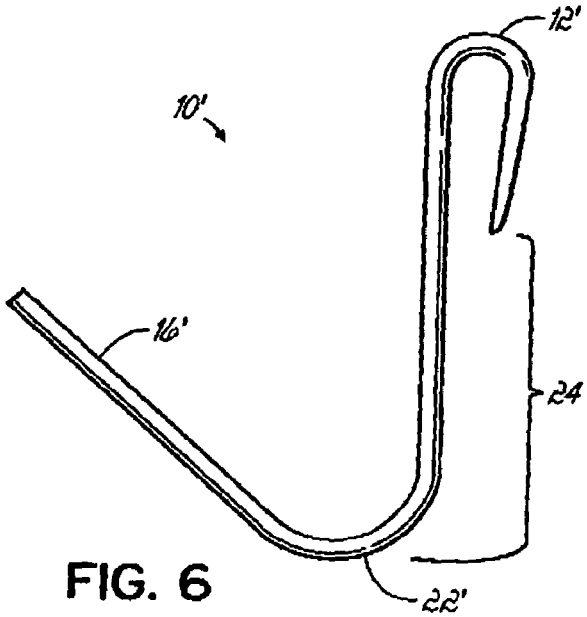
FIG. 6 is a side view of a second embodiment of the weightlifting belt hook of the present invention.
Figure 4:
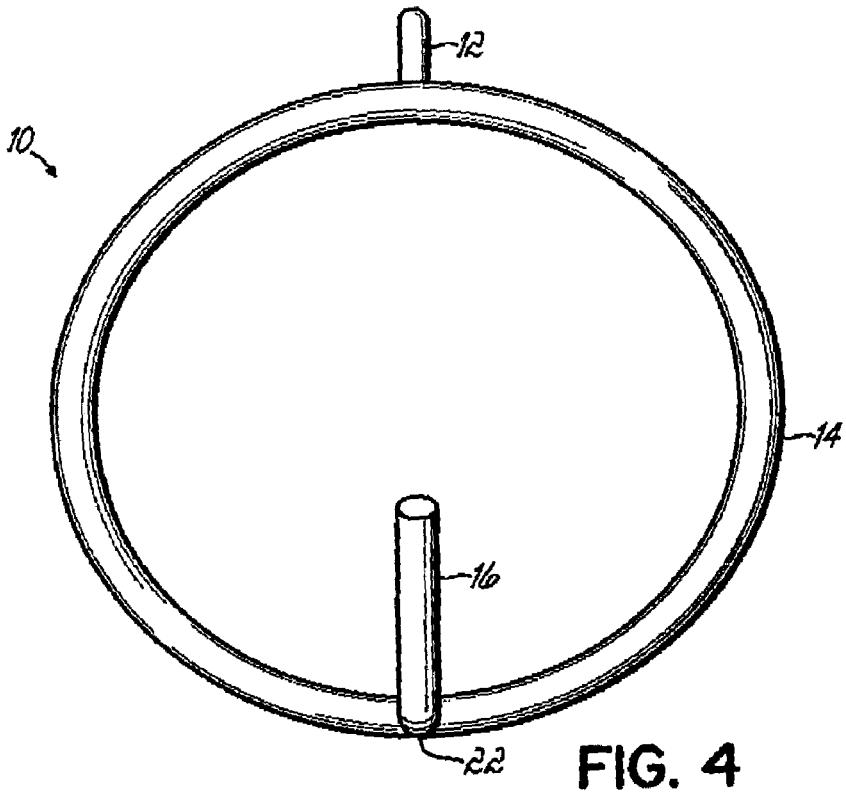
FIG. 4 is a front view of the weightlifting belt hook of FIG. 1 wherein the downwardly extending member is in the shape of a circle.
Figure 5:
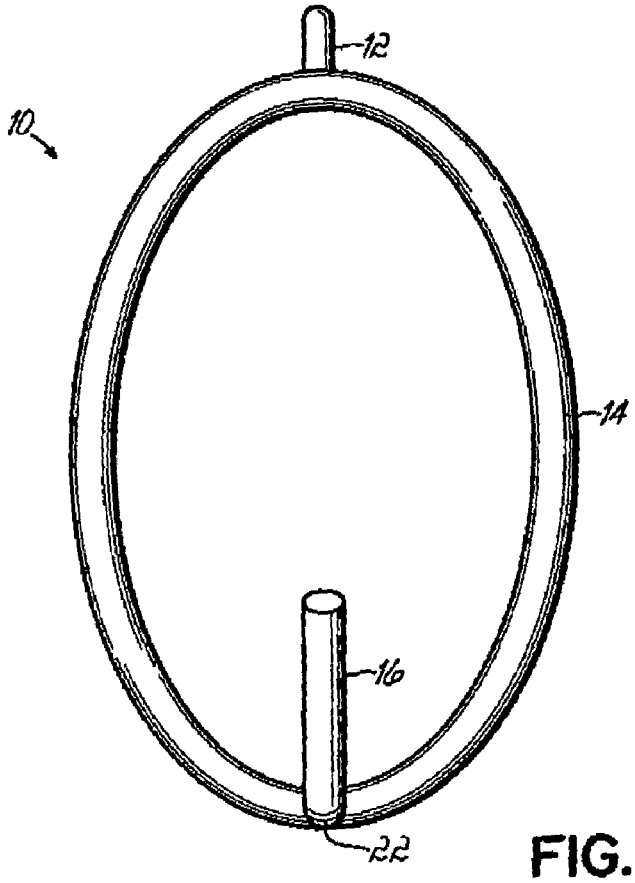
FIG. 5 is a front view of the weightlifting belt hook of FIG. 1 wherein the downwardly extending member is in the shape of an oval.

In another embodiment, the weightlifting belt hook 10' (as shown in FIG. 6) includes an anchor 12' and a J-shaped member 24. The J-shaped member extends downwardly from the anchor 12' and consists of a downwardly extending member 14' configured to extend over the pelvic area and provide an opening for the first portion that rounds out horizontally at the bottom 22' for the second portion and terminates in a weight supporting member 16' that extends upwardly and away from the user for the third portion. The weight supporting member 16' slidably receives The weight 18 so that the weight 18 rests at the bottom 22' of the weight supporting member 16' at the level of the user's thighs.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A weightlifting belt hook for attachment to a weightlifting belt worn by a user around the waist for selectively supporting one or more weight plates while exercising, said weightlifting belt hook comprising:

a hook anchor configured to engage at least a top edge of the weightlifting belt;

a downwardly extending stabilizing member depending from said hook anchor and having a length configured to extend from said hook anchor, over the pelvic area of the user, to a weight supporting member configured to be positioned over the thighs of the user;

said downwardly extending member constructed of rigid rod material and having an opening configured to be positioned over the pelvic area of the user;

said weight supporting member also constructed of rigid rod material extending generally upwardly from a bottom end of said downwardly extending member;

said weight supporting member having a linear portion of sufficient length to safely support a plurality of weight plates and extending generally acutely relative to the bottom end of said downwardly extending member, wherein a user wearing a weightlifting belt around their waist may attach the weightlifting belt hook to the weightlifting belt and selectively place one or more weight plates onto said weight supporting member to provide added resistance to the user's exercise and said downwardly extending stabilizing member minimizes swinging and hitting of the user's legs by the weights during exercise.

2. The weightlifting belt hook of claim 1 wherein said downwardly extending member and said weight supporting member in combination are J-shaped.

3. The weightlifting belt hook of claim 2 wherein the bottom of said downwardly extending member is rounded.

4. The weightlifting belt hook of claim 2 wherein said weights rest near the bottom of said weight supporting member.

5. The weightlifting belt hook of claim 2 wherein said weightlifting belt hook is made from steel.

6. The weightlifting belt hook of claim 1 wherein said downwardly extending member is comprised of at least one rod.

7. The weightlifting belt hook of claim 1 wherein said downwardly extending member is diamond shaped.

8. The weightlifting belt hook of claim 1 wherein said downwardly extending member is in the shape of a circle.

9. The weightlifting belt hook of claim 1 wherein said downwardly extending member is in the shape of an oval.

10. The weightlifting belt hook of claim 1 wherein the weights rest near the bottom of said weight supporting member.

11. The weightlifting belt hook of claim 1 wherein said weight supporting member is comprised of at least one rod.

12. The weightlifting belt hook of claim 1 wherein said weightlifting belt hook is made from steel.

* * * * *